United States Patent [19]

Jengo

[11] Patent Number: 5,022,949

[45] Date of Patent: Jun. 11, 1991

[54] VARIABLE VOLUME ETCHING MACHINE

[76] Inventor: James Jengo, U.S. Postal Service, 30th St. & Palisade Ave., Union City, N.J. 07087-0081

[21] Appl. No.: 592,858

[22] Filed: Oct. 4, 1990

[51] Int. Cl.[5] ..... C23F 1/02

[52] U.S. Cl. ..... 156/345; 156/625; 156/DIG. 111; 118/300

[58] Field of Search ..... 156/345, DIG. 111, 640, 156/625; 118/300, 249, 501, 694

[56] References Cited

U.S. PATENT DOCUMENTS

| | | | |
|---|---|---|---|
| 1,686,968 | 12/1924 | Harber | 118/300 |
| 2,293,201 | 1/1936 | Gaebel | 118/694 |
| 3,078,857 | 6/1960 | Guenst | 156/345 |
| 3,182,671 | 12/1962 | Vorie | 156/345 |
| 3,388,023 | 10/1966 | Benton et al. | 156/345 |
| 3,527,580 | 3/1967 | Bonlie | 118/300 |
| 4,426,251 | 1/1984 | Ida | 156/345 |

*Primary Examiner*—Richard Bueker
*Assistant Examiner*—George Goudreau
*Attorney, Agent, or Firm*—Ladas & Parry

[57] ABSTRACT

An etching machine having an upper frame member with side members connected together to define an etching chamber therein. The upper frame member having open top and bottom sections, wherein the top section is covered by a movable cover plate which moves between a first closed position in which the top section is closed to a second open position in which the top section is opened to expose the etching chamber. Within the etching chamber, rotatable cylinders, with cupped portions on their outermost surface, engage mordant within the etching machine to splash mordant on a rotating etching plate. Positioned underneath the upper frame member and the rotatable cylinder is a lower tank member for holding a supply of mordant. The lower tank section has an open top portion so that the mordant contained within the lower tank section is in fluid communication with the etching chamber and can contact the cupped portions of the rotatable cylinders. To vary the mordant capacity of the etching machine according to the mordant requirements for a particular etching, the positioning of the lower tank member, with respect to the upper frame member and the rotatable cylinders, is adjusted along an upright axis.

18 Claims, 8 Drawing Sheets

VARIABLE VOLUME ETCHING MACHINE

FIELD OF THE INVENTION

The present invention relates to an etching machine having improved efficiency in the use of mordant during process. More particularly, the present invention relates to an etching machine having an upper frame member, and a lower tank member, that can be moved along an upright axis with respect to each other so that the volume of mordant within the etching machine, relative to rotatable cylinders within the upper frame member that splash the mordant onto the etching plate, is adjusted according to the mordant requirements for a particular etching.

BACKGROUND OF THE INVENTION

In the field of etching machines, tanks holding the mordant have fixed volumes from which an etching plate is etched. Therefore, once the plate has been etched, the unused mordant still remains in the tank along with any by-products from the etching process. Consequently, the unused mordant becomes contaminated and needs to be discarded.

SUMMARY OF THE INVENTION

An object of the present invention is to provide an etching machine wherein the amount of the mordant in the etching machine can be varied to correspond closely to the etching requirements for a particular plate to be etched so that very little unused mordant remains after the plate has been etched.

More particularly, the present invention relates to a variable volume etching machine having an upper frame member with side members connected together with an etching chamber defined therein. The upper frame member has open top and bottom sections providing access to the etching chamber. Both the top and bottom sections, however, may be partially closed off by flange members extending inward from the side members.

Covering the top section of the upper frame member is a movable cover plate which moves between a first closed position, in which the top section is closed, to a second open position in which the top section is opened to expose the etching chamber. Connected to the cover plate and the upper frame member is a hinge assembly which allows pivotal movement of the cover plate between the first and second positions. Alternately, the cover plate can be moved, either manually or mechanically, by lifting the cover plate in the upright direction, sliding the cover plate in the horizontal direction, or combinations thereof. Furthermore, the hinge assembly can also be attached to a base support member, adjacent to the upper frame member, that rests on the ground.

To allow manual pivotal movement of the cover plate, a handle extends from a top surface of the cover plate at a position opposite from the connection between the cover plate and the hinge assembly. Additionally, in the closed first position, the cover plate rests against the flange members extending inwardly from the top section of the side walls to seal the top section. Alternatively, the cover plate can rest directly on top of the side walls.

Disposed on the top surface of the cover plate is a transmission means, connected to both a drive means and a rotatable drive shaft passing through an aperture in the cover plate, to rotate the drive shaft during the etching process. The transmission means comprises pulleys and a connecting belt therebetween with one pulley being connected to the drive shaft and the other pulley connected to the drive means. Other typical transmission means may be used instead or pulleys such as a gear assembly, or a motor connected directly to the drive shaft.

Connected to a bottom end of the drive shaft, adjacent a bottom surface of the cover plate, is an etching plate holder. The etching plate holder has an adjustable clamping means to secure various size etching plates to the etching plate holder. The clamping means includes typical screw clamps slidable within slots in the etching plate holder so that the clamping means can be adjusted to accommodate the area and thickness of the etching plate. Other types of clamping means may also be used to secure the etching plate to the etching plate holder.

To splash mordant on the etching plate during the etching process, rotatable cylinders, having cupped portions along their outermost surface, are disposed within the etching chamber. The rotatable cylinders are connected to shafts that pass through openings in the upper frame member so that a drive means, connected to the shafts, causes the cylinders to rotate. The drive means comprises a pulley assembly connected to a motor wherein adjacent shafts, and adjacent cylinders, are caused to rotate in opposite direction so that the cupped portions of the cylinders splash mordant within the etching machine between the cylinders and in the upright direction towards the etching plate when the cover plate is in the first closed position. Other typical drive means may be used instead of a pulley assembly and motor, such other means including a gear assembly connected to a motor or motors directly connected to each shaft.

Located below the upper frame member and the rotatable cylinders is a lower tank member for holding a supply of mordant. The lower tank section has an open top portion so that the mordant contained within the lower tank section is in fluid communication with the etching chamber and can contact the cupped portions of the rotatable cylinders. To vary the mordant capacity of the etching machine according to the mordant requirements for a particular etching, the positioning of the lower tank member, with respect to the upper frame member and the rotatable cylinders, is adjusted along an upright axis by an adjusting means. In this construction, the lower tank member can be filled with varying amounts of mordant, according to the particular etching requirements, and be positioned with respect to the rotatable cylinders so that volume of the mordant within the lower tank member is optimally utilized in the etching process. The lower tank member is also provided with known heating and cooling means to regulate the temperature of the mordant. The heating and cooling means can be combined as one unit or can be separate units. The lower tank member can also be provided with a drain means.

In one embodiment, the upper frame member is suspended above the ground by means of flanges, extending outward from the upper frame member, that engage inwardly extending support flanges on the base support member. In this construction, the upper frame member is movable in a fixed horizontal plane while the lower tank member, which overlaps the bottom section of the upper frame member, is movable, in the upright direction by a manual adjusting means, to vary the mordant capacity of the lower tank member relative to the upper frame member and the rotatable cylinders. The manual adjusting means includes columns of bores on the bottom section of the upper frame member, holes in the lower tank member that can be aligned with the columns of bores, and connecting rods passing through the holes to engage the bores so that the lower tank member is suspended by the upper frame member. Depending upon which horizontal plane of bores the connecting rods engage, the position of the lower tank member in the upright direction can be adjusted. To assist in the positioning and movement of the lower tank member, handles extend from the sides of the lower tank member.

In an alternative embodiment, the lower tank member rests on the ground and the upper frame member is moved in the upright direction to vary the mordant capacity within the etching machine relative to position of the rotatable cylinders. In this construction, flange members, extending from the bottom section of the upper frame member, rest on adjusting means that include adjusting blocks positioned within the lower tank member so that by adjusting the height of the adjusting blocks the mordant volume capacity of the etching machine is varied. To adjust the height of the adjusting blocks, the adjusting blocks can be stacked on top of one another, or adjusting blocks with predetermined dimensions can be used for a particular etching. Alternately, the relative positioning of the upper frame member with respect to the lower tank member can be adjusted by, for example, hydraulic means or mechanical means.

Other objects, features, and advantages of the invention will be apparent from the following detailed description of a preferred embodiment, with reference to the accompanying drawings.

DETAILED DESCRIPTION OF THE PREFERRED EMBODIMENT

Figure 2:
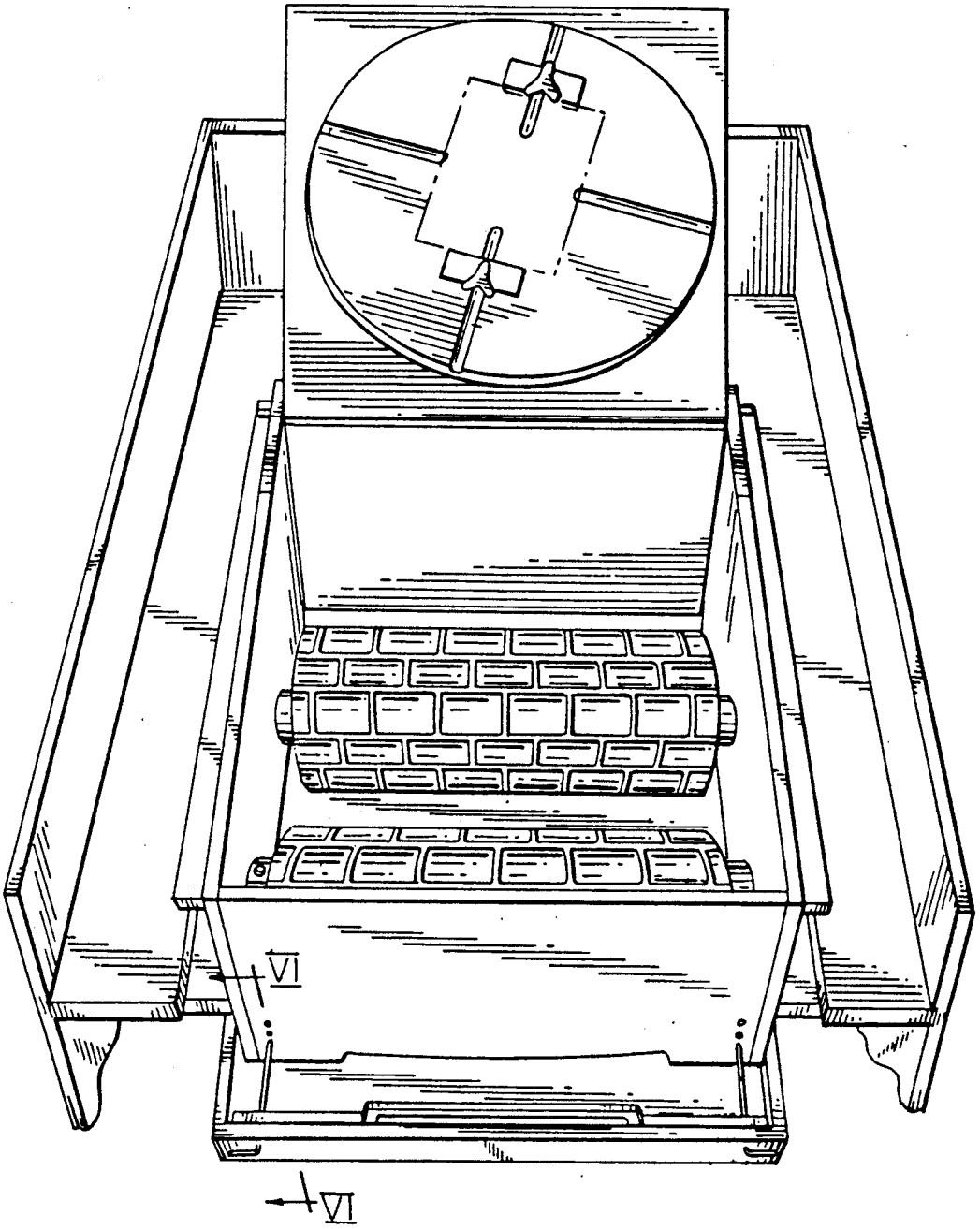
FIG. 2 is a perspective top view showing the cover plate in the open second position to expose the etching chamber.

The variable bath etching machine 1 includes an upper frame member 2 with side members 3 connected together to form a box with an etching chamber 4, as shown in FIG. 2, defined therein. The upper frame member 2 has open top section 5 and bottom section 6, shown in FIG. 2, providing access to etching chamber 4.

Figure 1:
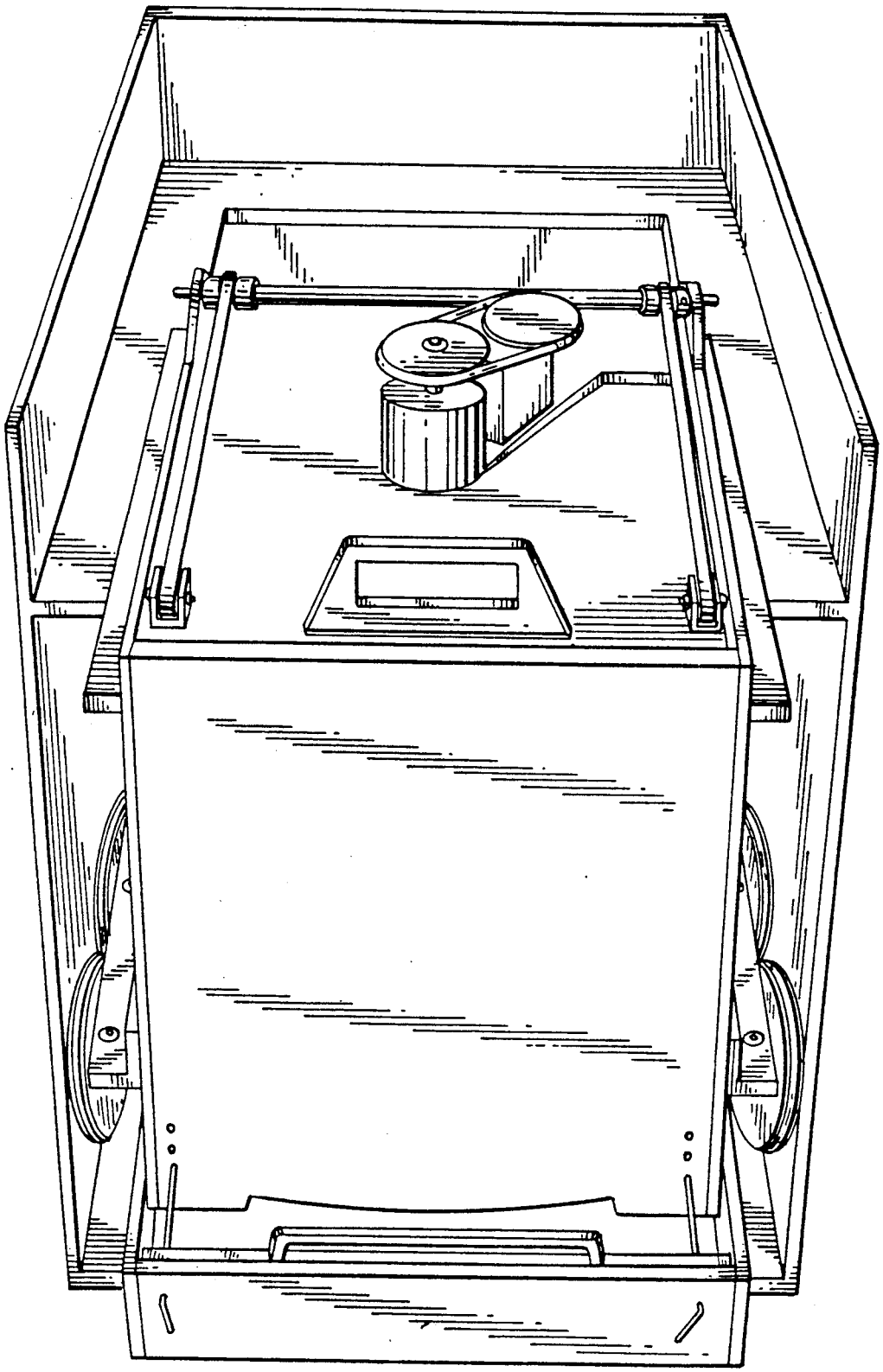
FIG. 1 is a front perspective view of the variable volume etching machine of the present invention.
Figure 3:
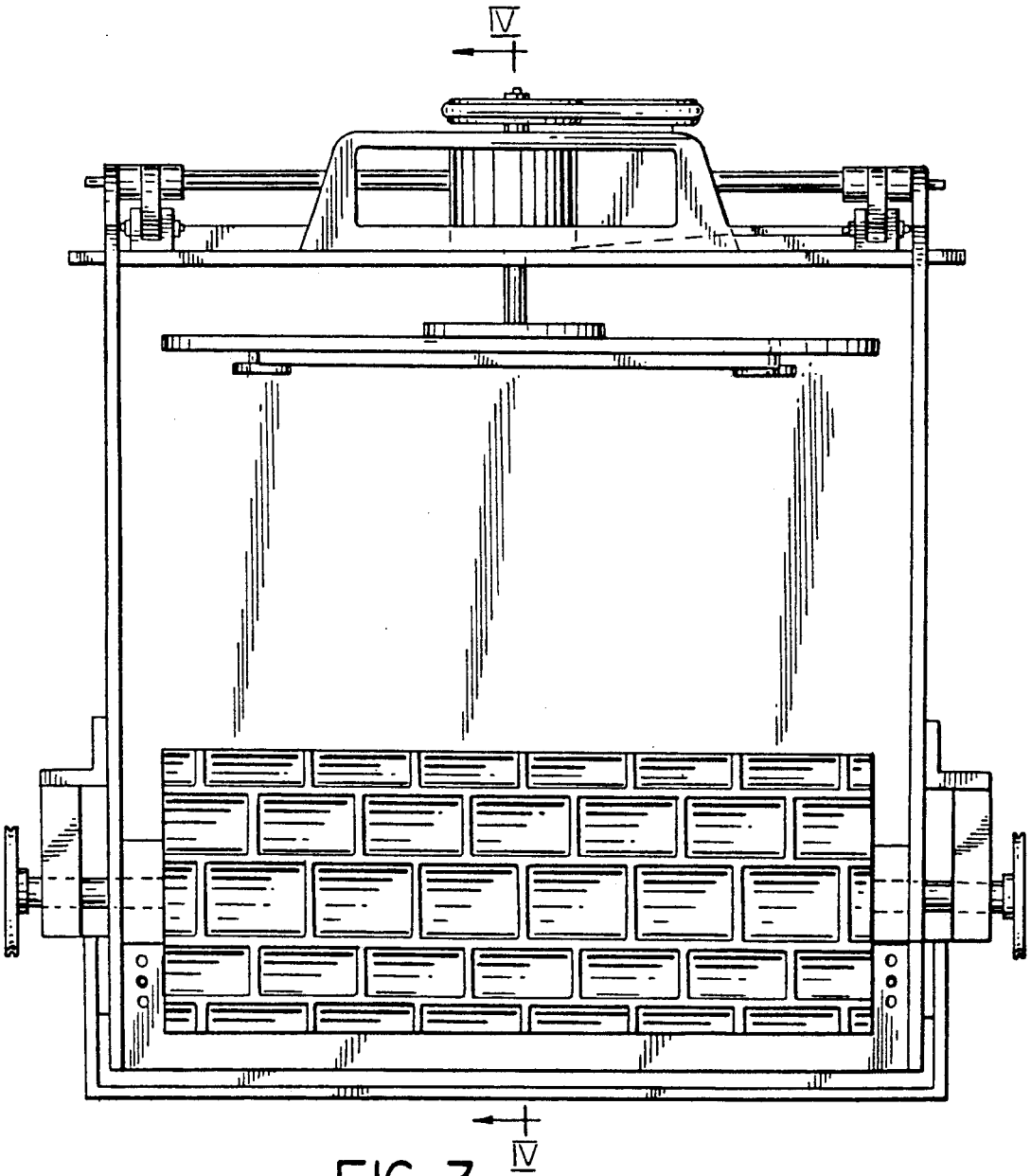
FIG. 3 is a cross-sectional view of the variable volume etching machine shown in FIG. 1.
Figure 4:
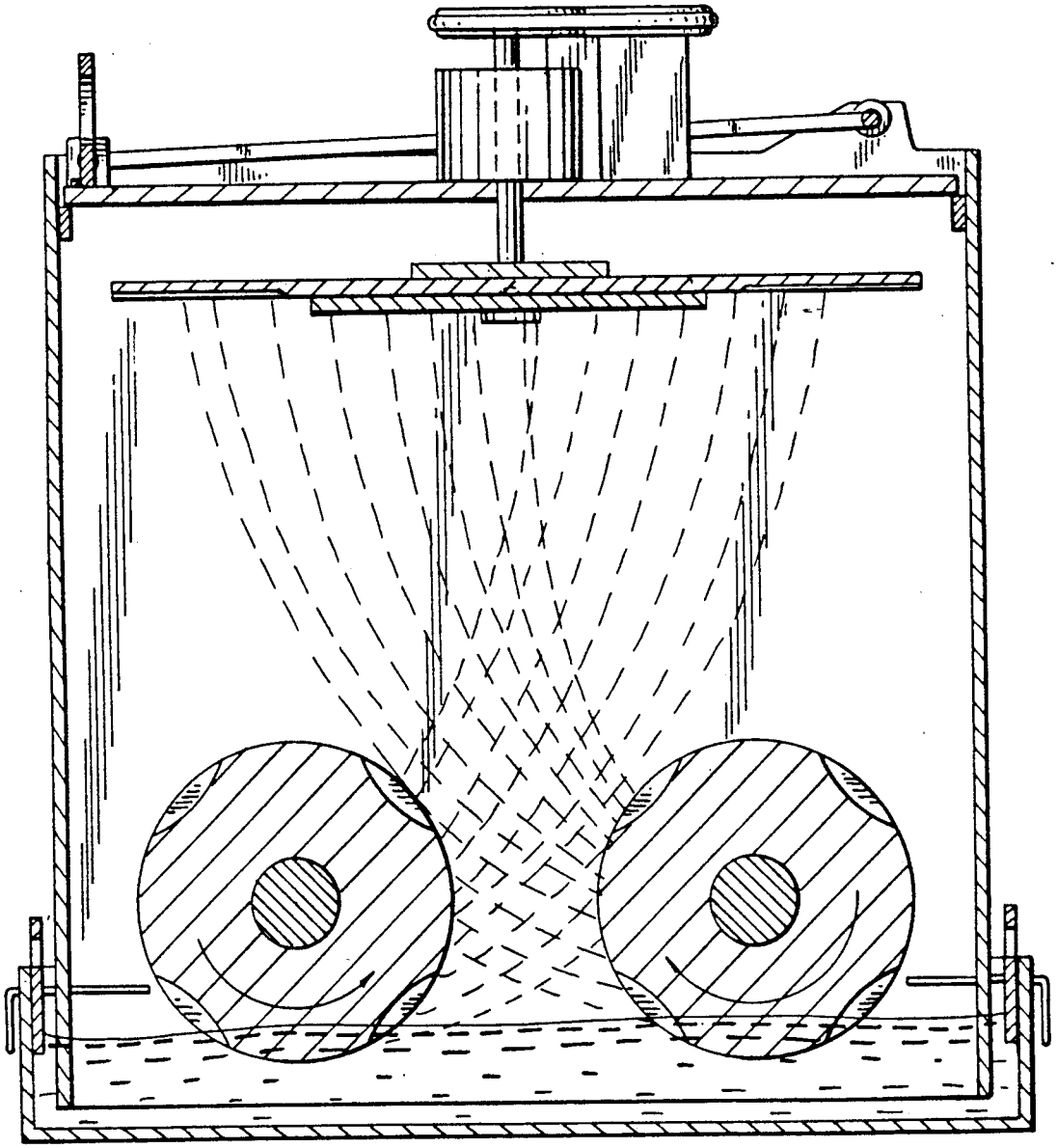
FIG. 4 is a cross-sectional view taken along line IV—IV of FIG. 3.
Figure 6:
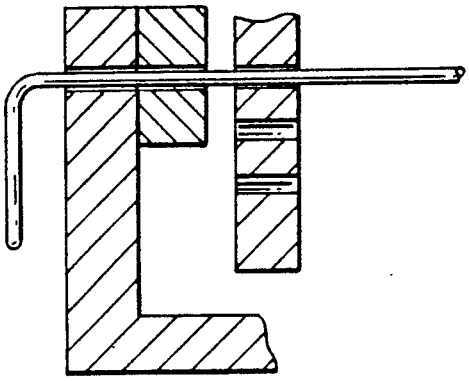
FIG. 6 is a cross-sectional view taken along line VI—VI of FIG. 2.

Covering top section 5 of upper frame member 2 is a movable cover plate 7 which can be moved between a first closed position in which the top section is closed, as shown in FIG. 1, to a second open position, as shown in FIG. 2, in which the top section is opened to expose etching chamber 4. Connected to a rear portion of cover plate 7 and upper frame member 2, is a hinge assembly 8, as shown in FIGS. 1, 3, and 4, which allows pivotal movement of cover plate 7 between the first and second positions. Hinge assembly 8 includes upright flanges 9 connected to a rearward portion of upper frame member 2, connecting rod 10 passing through upright flanges 9, and arms 11 pivotally mounted at a rear end to connecting rod 10 and pivotally mounted at a front end to a pin assembly 14, attached to a forward portion of top surface 15, of cover plate 7, so that the cover plate pivots about connecting rod 10 when cover plate 7 is moved between the first open position and the closed second position. To manually move cover plate 7 between the first and second positions, handle 12 extends from the forward portion of cover plate 7 so that in use the cover plate can be lifted open by pulling up on handle 12.

To provide support for cover plate 7 in the first closed position, upper flange members 13, as shown in FIG. 4, extends inwardly from top section 5 of side walls 3. In the closed first position, bottom surface 16, of cover plate 7, abuts against upper flange members 13 so as to seal the top section.

Disposed on top surface 15 of cover plate 7 is a transmission means 17, as shown in FIGS. 1, 3 and 4, connected to motor 18 and rotatable drive shaft 19. Transmission means 17 includes a first pulley 20 connected to a top end of rotatable drive shaft 19, a second pulley 21 connected to motor 18, and a connecting belt 22 connected to the first and second pulleys so that activation of the motor causes rotation of rotatable drive shaft 19.

As shown in FIG. 4, rotatable drive shaft 19 passes through an aperture 23 in the cover plate, and is connected at a bottom end, adjacent bottom surface 16 of cover plate 7, to etching plate holder 24. To maintain the upright alignment of rotatable drive shaft 19, rotatable drive shaft 19 passes through bearing means 25, positioned on top surface 15, before passing through aperture 23.

As shown in FIG. 2, adjustable clamping means 26, connected to etching plate holder 24, allows etching plate holder 24 to accommodate various size etching plates 27. Adjustable clamping means 26 includes screw clamps 28 having securing tabs 29 so that in use tightening of screw clamps 28 presses tabs 29 against etching plate 27 and etching plate 27 against bottom surface 16. To accommodate various size etching plates, screw clamps 28 are slidable within, and engage, slots 30 in the etching plate holder 24 to accommodate the area of various etching plates 27.

To splash mordant 31 on the etching plate 27, as shown in FIG. 4, rotatable cylinders 32, having cupped portions 33 along their outermost surface 34, are disposed within etching chamber 4. Rotatable cylinders 32 are connected to shafts 35, as shown in FIG. 3, that pass through openings 36 in the upper frame member so that rotation of shafts 35 causes cylinders 32 to rotate. To maintain the horizontal alignment of shafts 35, shafts 35 pass through flange bearing means 37, connected to opposite side walls 4, before passing through openings 36.

Connected to outward portions of shafts 35 is cylinder drive means 38. As shown in FIGS. 1 and 3, cylinder drive means 38 comprises a pulley assembly 39 connected to a motor (not shown), wherein in operation, the arrangement of the pulley assembly causes adjacent shafts 35 to rotate in opposite direction, as shown in FIG. 4, so that the cupped portions of cylinders 32 splash mordant 31 between adjacent cylinders, and in the upright direction, towards etching plate 27 as it is rotating.

Figure 5:
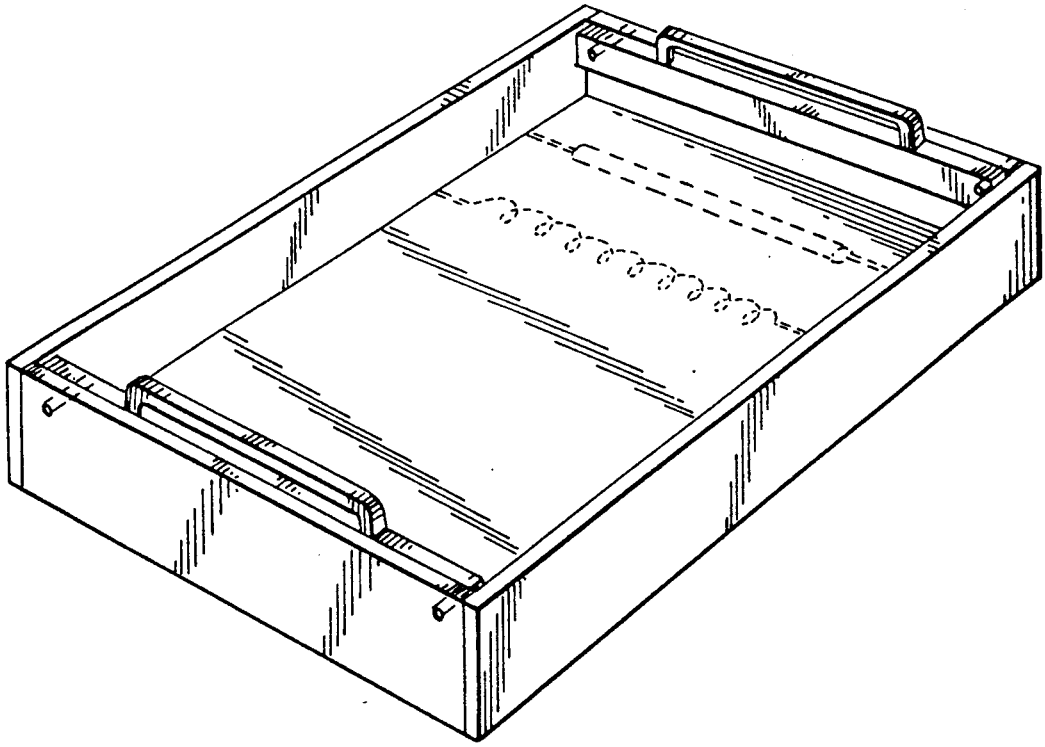
FIG. 5 is perspective view of the lower tank member of the present invention.

Located below upper frame member 2 and rotatable cylinders 32, is a lower tank member 40 for holding a supply of mordant 31. As shown in FIGS. 4 and 5, lower tank member 40 has an open top portion 41 so that the mordant contained within lower tank member 40 can be placed in fluid communication with etching chamber 4 and can contact the cupped portions of rotatable cylinders 32. To vary the mordant capacity of etching machine 1 according to the mordant requirements for a particular etching, the positioning of lower tank member 40, with respect to upper frame member 2 and the rotatable cylinders 32, is adjusted along an upright axis by an adjusting means 42. In operation, the lower tank member is filled with an amount of mordant, according to the particular etching requirements, and positioned, by means of adjusting means 42, with respect to rotatable cylinders 32 so that volume of the mordant within the lower tank member is optimally utilized in the etching process.

The lower tank member, as shown in FIG. 5, is also provided with a heating means 43 and cooling means 44 to regulate the temperature of the mordant. The heating and cooling means can be separate units within the lower tank member, or can be combined as one unit.

In the first embodiment as shown in FIGS. 1–6, upper frame member 2 is suspended above the ground by means of flanges 45, extending outward from the upper frame member, engaging support flanges 46, shown in FIGS. 1 and 2, that extend inward from base support member 47 that rests on the ground. In this construction, the upper frame member is movable in a fixed horizontal plane while the lower tank member, which overlaps the bottom section of the upper frame member, is movable, in the upright direction by means of the manual adjusting means, so as to vary the mordant capacity of the lower tank member relative to the upper frame member and the rotatable cylinders.

In the first embodiment, adjusting means 42 includes columns of bores 48 on the bottom section of the upper frame member, holes 49 in the lower tank member that can be aligned with the columns of bores 48, and connecting rods 50 passing through holes 49 to engage bores 48 so that the lower tank member is suspended by the upper frame member. Depending upon which horizontal plane of bores the connecting rods engage, the upright position of the lower tank member can be adjusted. To assist in the positioning and movement of the lower tank member, handles 51 extend from opposite sides of the lower tank member. To assist the flow of the mordant to the etching chamber, and prevent mordant surge, at least one side wall, by the bottom section of the upper frame member, defines a cut-out portion 52.

In operation, etching plate 27 is secured to etching plate holder 24 by clamping means 26, and cover plate 7 is moved to the first closed position. In addition, lower tank member 40 is filled with a volume of mordant 31 corresponding to the amount needed to etch etching plate 27, and is moved underneath upper frame member 2 to a position, in the upright direction, corresponding to the horizontal plane in which rotating cylinders 32 will most efficiently use the mordant in etching the etching plate. In that position, connecting rods 50 are inserted into through holes 49 and bores 48, that are in the same horizontal plane, so that lower tank member is maintained in that predetermined horizontal plane. Etching machine 1 is then turned on, etching plate 27 is caused to rotate, and mordant is splashed onto the etching plate as it is rotating.

Figure 7:
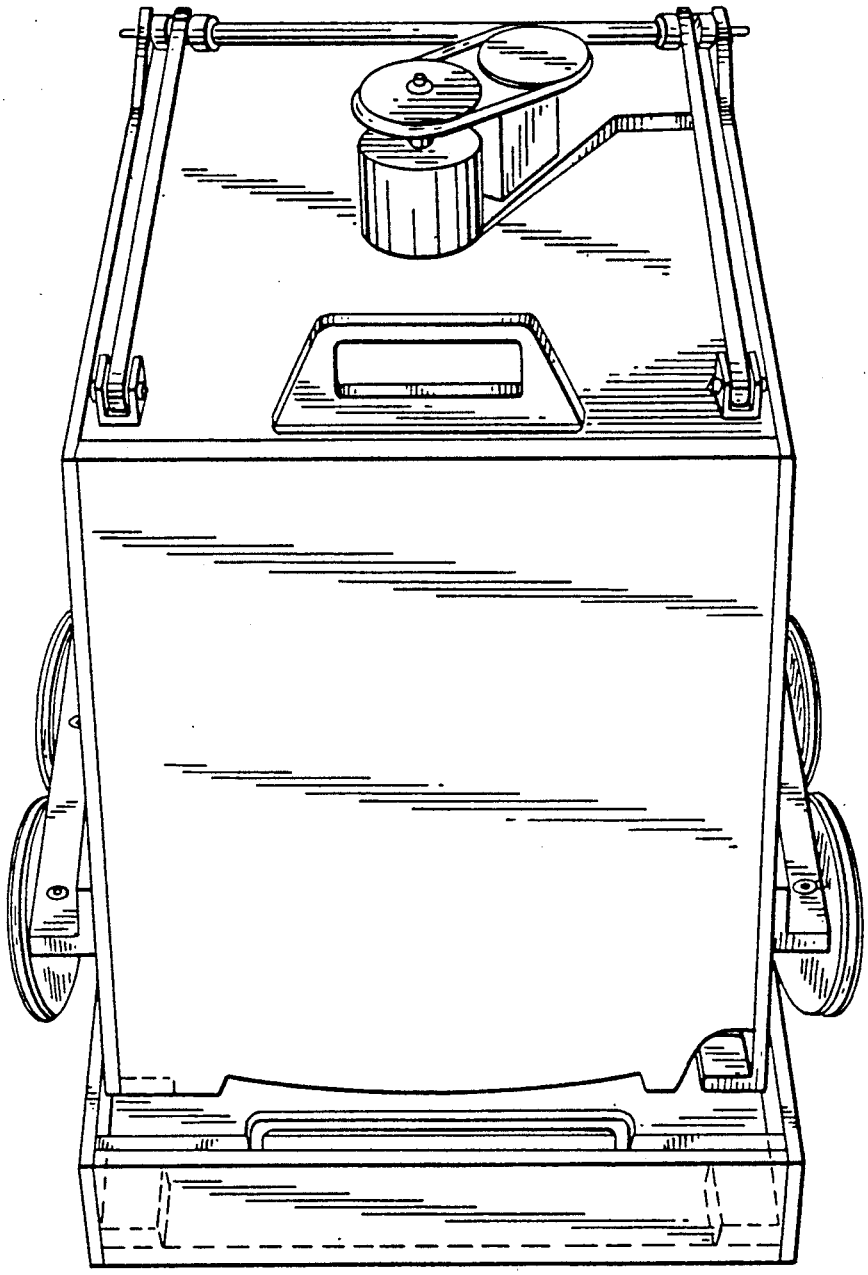
FIG. 7 is a front perspective view of an alternative embodiment of the variable volume etching machine of the present invention.
Figure 8:
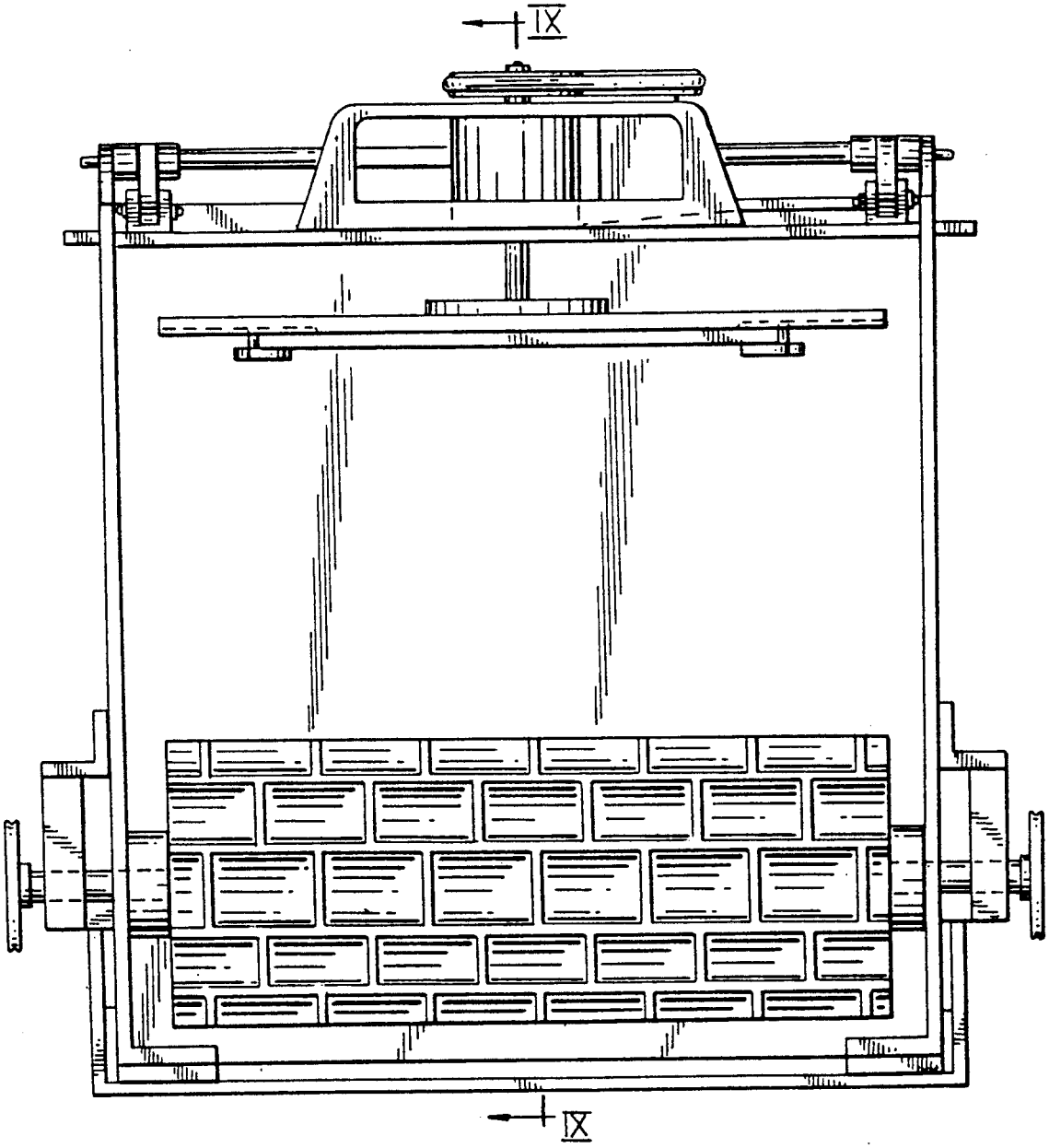
FIG. 8 is a cross-sectional view of the variable volume etching machine shown in FIG. 7.
Figure 9:
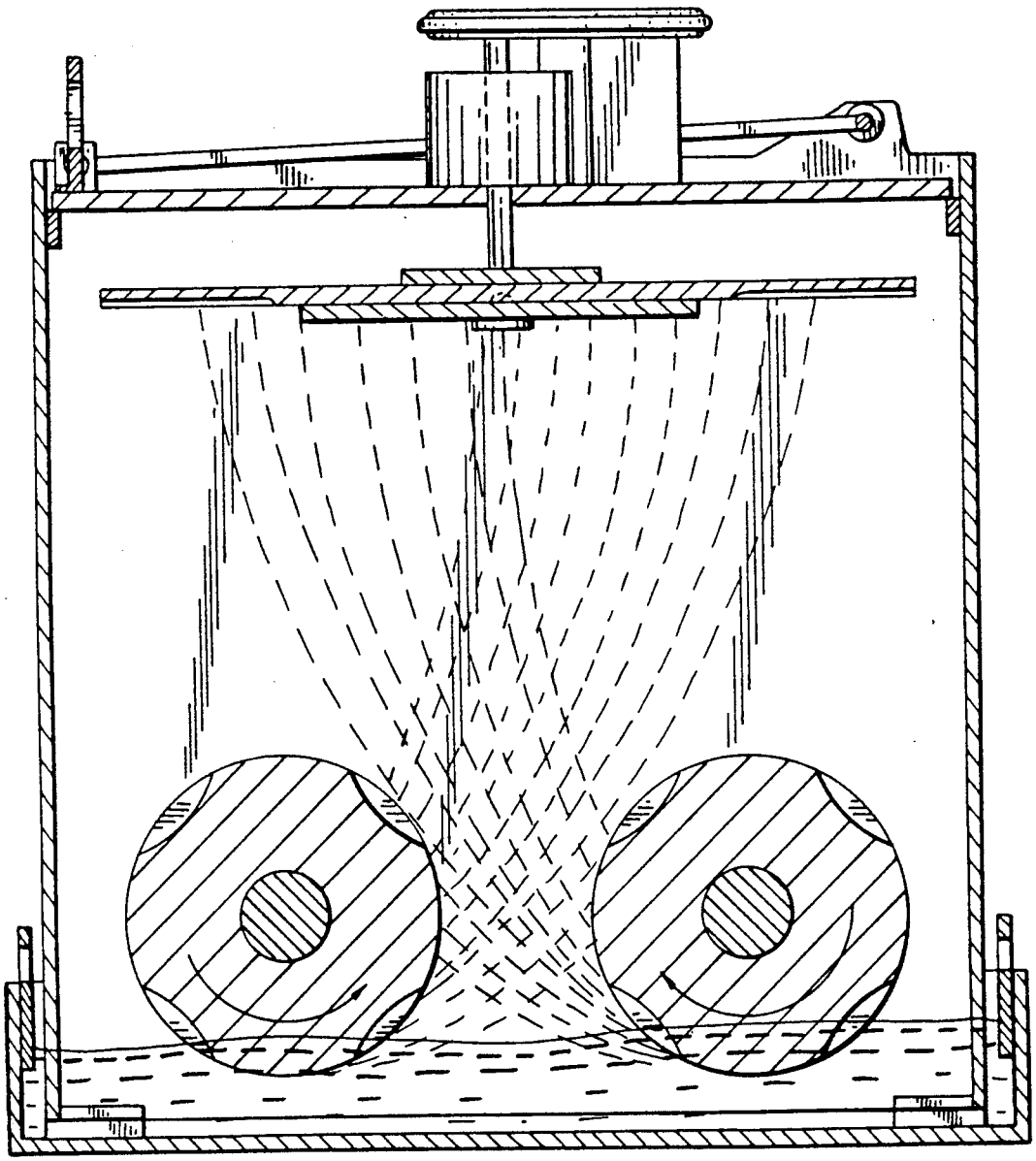
FIG. 9 is a cross-sectional view taken along line IX—IX of FIG. 8.

In an alternative embodiment of the present invention, as shown in FIGS. 7–9, lower tank member 40 rests on the ground and upper frame member 2 is moved in the upright direction to vary the relative mordant capacity within the etching machine relative to the position of rotatable cylinders 32. In this construction, lower flange members 53, extending from the bottom section of the upper frame member, rest on adjusting means 42. In the alternative embodiment, adjusting means 42 comprises adjusting blocks 54 positioned within the lower tank member so that by adjusting the height of the adjusting block the relative mordant volume capacity of the etching machine can be varied.

In operation, etching plate 27 is secured to etching plate holder 24 by clamping means 26, and cover plate 7 is moved to the first closed position. In addition, lower tank member 40 is filled with a volume of mordant 31 corresponding to the amount needed to etch etching plate 27, and adjusting blocks 54 are placed within the lower tank member that correspond, when the upper frame member is positioned on top of the adjusting blocks, to the horizontal plane in which rotating cylinders 32 will most efficiently use the mordant in etching the etching plate. In that position, the upper frame member is maintained in that predetermined horizontal plane. Etching machine 1 is then turned on, etching plate 27 is caused to rotate, and mordant is splashed onto the etching plate as it is rotating.

I claim:

1. An etching machine comprising:

an upper frame member having side members connected together to define an etching chamber therein, said upper frame member having open top and bottom sections;

a cover plate, movable between a first closed position wherein said top section is closed and said cover plate rests on said upper frame member, to a second open position wherein said top section is open to expose said etching chamber;

a motive transmission means, connected to a rotatable drive shaft passing through an aperture in said cover plate so that in use activation of said motive transmission means causes rotation of said rotatable drive shaft;

an etching plate holder within said etching chamber, and connected to said rotatable drive shaft, so that rotation of said rotatable drive shaft causes rotation of said etching plate holder;

an adjustable clamping means connected to said etching plate holder to secure an etching plate to said etching plate holder;

splashing means within said etching chamber for engaging a supply of mordant within said etching machine and splashing said mordant onto said etching plate as said etching plate is being rotated;

a lower tank member for holding said supply of mordant and having an open top portion so in use said lower tank section is in fluid communication with said upper frame member and said splash means; and adjusting means engaging said upper frame member and said lower tank member so that said upper frame member and said lower tank member can be moved along an upright axis with respect to each other so that the volume of mordant within the etching machine, relative to said splashing means, is adjustable according to the mordant requirements for a particular etching plate.

2. The etching machine according to claim 1, wherein the upper frame member is slidingly supported by a base support member so that the upper frame member is supported above the ground.

3. The etching machine according to claim 2, wherein the adjusting means comprises connecting rods that are engagable with at least two upright columns of bores formed in the side members and are engagable with holes in the lower tank member so that the lower tank member can be suspended from the upper frame member by means of said connecting rods and the position of the lower tank member along the upright axis, and the mordant volume capacity relative to the splash means, are adjustable according to the horizontal plane of bores said connecting rods engage.

4. The etching machine according to claim 3, wherein in use the lower tank member overlaps the side members of the upper frame member.

5. The etching machine according to claim 4, wherein the splash means includes rotatable parallel cylinders, having cupped portions along their outermost surfaces, that engage the mordant and splash the mordant onto the etching plate, said rotatable cylinders are mounted to shafts that pass through the side members and are connected to a drive means so that in use adjacent rotatable cylinders rotate in opposite directions.

6. The etching machine according to claim 5, wherein the cover plate is pivotally mounted to the upper frame member by means of a hinge assembly connected to the upper frame member and said cover plate.

7. The etching machine according to claim 6, wherein the motive transmission means is connected to said cover plate and includes a first pulley connected to the rotatable drive shaft, a second pulley connected to a motor on the cover plate, and a drive belt connected to said first and second pulleys.

8. The etching machine according to claim 7, wherein a heat exchanging means within the lower tank member adjusts the temperature of the mordant.

9. The etching machine according to claim 8, wherein a portion of at least one side member, by the bottom section, defines an opening to facilitate the flow of mordant to the etching chamber and prevent mordant surge.

10. The etching machine according to claim 1, wherein lower flange members extend inwardly from the bottom section of the upper frame member.

11. The etching machine according to claim 10, wherein the adjusting means comprises adjusting blocks positioned between the lower tank member and the upper frame member so as to adjust the position of the upper frame member in the upright axis so that the mordant volume capacity relative to the splash means can be adjusted.

12. The etching machine according to claim 11, wherein in use the lower tank member overlaps the side members of the upper frame member.

13. The etching machine according to claim 12, wherein the splash means includes rotatable parallel cylinders, having cupped portions along their outermost surfaces, that engage the mordant and splash the mordant onto the etching plate, said rotatable cylinders are rotatably mounted to shafts that pass through the side members and are connected to a drive means so that in use adjacent rotatable cylinders rotate in opposite directions.

14. The etching machine according to claim 13, wherein the cover plate is pivotally mounted to the upper frame member by means of a hinge assembly connected to the upper frame member and said cover plate.

15. The etching machine according to claim 14, wherein the motive transmission means is connected to said cover plate and includes a first pulley connected to the rotatable drive shaft, a second pulley connected to a motor on the cover plate, and a drive belt connected to said first and second pulleys.

16. The etching machine according to claim 15, wherein a heat exchanging means within the lower tank member adjusts the temperature of the mordant.

17. The etching machine according to claim 16, wherein a portion of at least one side member, by the bottom section, defines an opening to facilite the flow of mordant to the etching chamber and prevent mordant surge.

18. An etching machine comprising:

upper frame means for defining an etching chamber therein, said upper frame means having open, opposite top and bottom ends;

cover plate means movable between a first, closed position covering said top end and a second, open position exposing said top end and etching chamber;

etching plate holder means within said etching chamber for holding and rotating an etching plate;

a lower tank member for holding a supply of a mordant and having an open top for receiving said upper frame means;

splashing means within said etching chamber for splashing said mordant onto said etching plate as said etching plate is being rotated in dependenance upon a position of said splashing means relative to said supply of said mordant; and adjusting means operative between said upper frame means and said lower tank member for adjusting said position of said splashing means relative to said supply of said mordant.

* * * * *